US007138039B2

(12) United States Patent
Burkhart et al.

(10) Patent No.: US 7,138,039 B2
(45) Date of Patent: Nov. 21, 2006

(54) LIQUID ISOLATION OF CONTACT RINGS

(75) Inventors: Vincent E. Burkhart, San Jose, CA (US); Harald Herchen, Los Altos, CA (US); Joseph Yahalom, Emeryville, CA (US)

(73) Assignee: Applied Materials, Inc., Santa Clara, CA (US)

( * ) Notice: Subject to any disclaimer, the term of this patent is extended or adjusted under 35 U.S.C. 154(b) by 424 days.

(21) Appl. No.: 10/348,800

(22) Filed: Jan. 21, 2003

(65) Prior Publication Data

US 2004/0140203 A1 Jul. 22, 2004

(51) Int. Cl.
*B23H 3/04* (2006.01)
*C25D 17/06* (2006.01)

(52) U.S. Cl. ..... 204/286.1; 204/224 R; 204/287; 204/288.3; 204/297.01; 204/297.06; 204/297.08; 204/297.09; 204/297.1; 204/297.14

(58) Field of Classification Search ..... 204/224 R, 204/297.01, 297.03, 297.06, 297.07, 297.08, 204/297.09, 297.1, 297.14, 286.1, 287, 288.3
See application file for complete search history.

(56) References Cited

U.S. PATENT DOCUMENTS

| | | | | |
|---|---|---|---|---|
| 3,649,509 | A | 3/1972 | Morawetz et al. | 204/238 |
| 3,727,620 | A | 4/1973 | Orr | 134/95 |
| 3,770,598 | A | 11/1973 | Creutz | 204/52 R |
| 4,027,686 | A | 6/1977 | Shortes et al. | 134/33 |
| 4,092,176 | A | 5/1978 | Kozai et al. | 134/186 |
| 4,110,176 | A | 8/1978 | Creutz et al. | 204/52 R |
| 4,113,492 | A | 9/1978 | Sato et al. | 96/67 |
| 4,304,641 | A | 12/1981 | Grandia et al. | 204/23 |
| 4,315,059 | A | 2/1982 | Raistrick et al. | 429/112 |
| 4,326,940 | A | 4/1982 | Eckles et al. | 204/232 |
| 4,336,114 | A | 6/1982 | Mayer et al. | 204/52 R |
| 4,376,685 | A | 3/1983 | Watson | 204/52 R |
| 4,405,416 | A | 9/1983 | Raistrick et al. | 204/68 |
| 4,428,815 | A | 1/1984 | Powell et al. | 204/297 W |
| 4,435,266 | A | 3/1984 | Johnston | 204/276 |
| 4,489,740 | A | 12/1984 | Rattan et al. | 134/140 |
| 4,510,176 | A | 4/1985 | Cuthbert et al. | 427/82 |
| 4,518,678 | A | 5/1985 | Allen | 430/311 |
| 4,519,846 | A | 5/1985 | Aigo | 134/15 |
| 4,693,805 | A | 9/1987 | Quazi | 204/192.22 |
| 4,732,785 | A | 3/1988 | Brewer | 427/240 |
| 4,789,445 | A | 12/1988 | Goffman et al. | 204/114 |

(Continued)

FOREIGN PATENT DOCUMENTS

| | | |
|---|---|---|
| JP | 58182823 | 10/1983 |

(Continued)

OTHER PUBLICATIONS

Colombo, "Wafer Back Surface Film Removal," Central R&D, SGS-Thomson Microelectronics, Agate Italy, no month/ yr available.

(Continued)

*Primary Examiner*—Bruce F. Bell
(74) *Attorney, Agent, or Firm*—Patterson & Sheridan LLP

(57) ABSTRACT

Embodiments of the invention may further provide a contact ring for an electrochemical plating system. The contact generally includes a substrate receiving member having a substrate support surface formed thereon, a plurality of electrical contact pins extending from the substrate support surface, a first seal positioned on the substrate support surface radially inward of the plurality of electrical contacts, and a second seal positioned radially outward of the plurality of electrical contacts. Additionally, the contact ring generally includes a fluid inlet configured to supply a fluid to a volume between the first seal and the second seal.

6 Claims, 3 Drawing Sheets

U.S. PATENT DOCUMENTS

| | | | | |
|---|---|---|---|---|
| 5,039,381 | A | 8/1991 | Mullarkey | 204/47.5 |
| 5,055,425 | A | 10/1991 | Leibovitz et al. | 437/195 |
| 5,092,975 | A | 3/1992 | Yamamura et al. | 204/198 |
| 5,155,336 | A | 10/1992 | Gronet et al. | 219/411 |
| 5,162,260 | A | 11/1992 | Leibovitz et al. | 437/195 |
| 5,222,310 | A | 6/1993 | Thompson et al. | 34/202 |
| 5,224,504 | A | 7/1993 | Thompson et al. | 134/155 |
| 5,230,743 | A | 7/1993 | Thompson et al. | 134/32 |
| 5,252,807 | A | 10/1993 | Chizinsky | 219/390 |
| 5,377,708 | A | 1/1995 | Bergman et al. | 134/105 |
| 5,429,733 | A | 7/1995 | Ishida | 204/224 R |
| 5,447,615 | A | 9/1995 | Ishida | 204/22 R |
| 5,516,412 | A | 5/1996 | Andricacos et al. | 204/224 R |
| 5,608,943 | A | 3/1997 | Konishi et al. | 15/302 |
| 5,625,170 | A | 4/1997 | Poris | 177/50 |
| 5,705,223 | A | 1/1998 | Bunkofske | 427/240 |
| 5,718,813 | A | 2/1998 | Drummond et al. | 204/192.12 |
| 5,723,028 | A | 3/1998 | Poris | 204/231 |
| 5,985,126 | A | 11/1999 | Bleck et al. | 205/123 |
| 6,001,234 | A | 12/1999 | Batz, Jr. et al. | 205/123 |
| 6,004,440 | A | 12/1999 | Hanson et al. | 204/279 |
| 6,004,828 | A | 12/1999 | Hanson | 438/7 |
| 6,080,291 | A | 6/2000 | Woodruff et al. | 204/297.01 |
| 6,090,291 | A | 7/2000 | Akai et al. | 210/669 |
| 6,103,085 | A | 8/2000 | Woo et al. | 205/143 |
| 6,103,628 | A | 8/2000 | Talieh | 438/692 |
| 6,139,703 | A | 10/2000 | Hanson et al. | 204/212 |
| 6,139,712 | A | 10/2000 | Patton et al. | 205/143 |
| 6,159,354 | A | 12/2000 | Contolini et al. | 205/96 |
| 6,176,992 | B1 | 1/2001 | Talieh | 205/87 |
| 6,193,859 | B1 | 2/2001 | Contolini et al. | 204/224 R |
| 6,207,572 | B1 | 3/2001 | Talieh | 438/692 |
| 6,248,222 | B1 * | 6/2001 | Wang | 204/297.09 |
| 6,251,050 | B1 | 6/2001 | Johnston | 428/57 |
| 6,251,235 | B1 | 6/2001 | Talieh et al. | 204/220 |
| 6,270,647 | B1 | 8/2001 | Graham et al. | 205/99 |
| 6,274,010 | B1 | 8/2001 | Henington et al. | 204/230.3 |
| 6,274,013 | B1 | 8/2001 | Bleck et al. | 204/297.08 |
| 6,309,524 | B1 | 10/2001 | Woodruff et al. | 204/297.1 |
| 6,328,872 | B1 | 12/2001 | Talieh et al. | 205/206 |
| 6,352,623 | B1 | 3/2002 | Volodarsky et al. | 204/275.4 |
| 6,355,153 | B1 | 3/2002 | Uzoh et al. | 205/87 |
| 6,358,388 | B1 | 3/2002 | Bleck et al. | 205/118 |
| 6,402,925 | B1 | 6/2002 | Talieh | 205/222 |
| 6,409,904 | B1 | 6/2002 | Uzoh et al. | 205/137 |
| 6,413,388 | B1 | 7/2002 | Uzoh et al. | 204/224 R |
| 6,413,403 | B1 | 7/2002 | Lindquist et al. | 205/97 |
| 6,464,571 | B1 | 10/2002 | Talieh et al. | 451/296 |
| 6,468,139 | B1 | 10/2002 | Talieh et al. | 451/296 |
| 6,471,847 | B1 | 10/2002 | Talieh et al. | 205/147 |
| 6,478,936 | B1 | 11/2002 | Volodarsky et al. | 204/286.1 |
| 6,479,159 | B1 | 11/2002 | Bruening et al. | 427/470 |
| 6,482,307 | B1 | 11/2002 | Ashjaee et al. | 205/103 |
| 6,497,800 | B1 | 12/2002 | Talieh et al. | 204/224 R |
| 6,514,258 | B1 | 2/2003 | Brown et al. | 606/80 |
| 6,534,116 | B1 | 3/2003 | Basol | 427/97 |
| 6,540,899 | B1 | 4/2003 | Keigler | 205/118 |

FOREIGN PATENT DOCUMENTS

| | | |
|---|---|---|
| JP | 63118093 | 5/1988 |
| JP | 4131395 | 5/1992 |
| JP | 4280993 | 10/1992 |
| JP | 6-17291 | 1/1994 |
| WO | 97/12079 | 4/1997 |
| WO | 99/25902 | 5/1999 |
| WO | 99/25903 | 5/1999 |
| WO | 99/25904 | 5/1999 |
| WO | 99/25905 | 5/1999 |
| WO | 99/26275 | 5/1999 |

OTHER PUBLICATIONS

Semitool Product Catalog (on-line) Oct. 27, 1998.

Singer, "Copper Has Enormous Benefits When Compared to Aluminum, but its Implementation Requires Some Fundamental Changes in Process Technologies," Semiconductor International Jun. 1998.

Singer, "Wafer Processing," Semiconductor International Jun. 1998.

Pitney, "Ney Contact Manual" Oct. 1974.

* cited by examiner

LIQUID ISOLATION OF CONTACT RINGS

BACKGROUND OF THE INVENTION

1. Field of the Invention

Embodiments of the invention relate to a method and apparatus for contacting a substrate, and more particularly, to a method and apparatus used to contact a substrate during an electrochemical plating process.

2. Background of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio, i.e., greater than about 4:1, interconnect features with a conductive material, such as copper, aluminum, nickel, gold, or other conductive material. Conventionally, deposition techniques such as chemical vapor deposition (CVD) and physical vapor deposition (PVD) have been used to fill these interconnect features. However, as the interconnect sizes decrease and aspect ratios increase, void-free interconnect feature fill via conventional metallization techniques, i.e., PVD and CVD, for example, becomes increasingly difficult. Therefore, plating techniques, i.e., electrochemical plating (ECP) and electroless plating, have emerged as promising processes for void free filling of sub-quarter micron sized high aspect ratio interconnect features in integrated circuit manufacturing processes.

In an ECP process, for example, sub-quarter micron sized high aspect ratio features formed into the surface of a substrate (or a dielectric layer deposited thereon) may be efficiently filled with a conductive material, such as copper. ECP plating processes are generally two stage processes, wherein a seed layer is first formed over the surface features of the substrate or dielectric layer, and then the surface features are exposed to an electrolyte solution, while an electrical bias is applied between the seed layer and a copper anode positioned within the electrolyte solution. The electrolyte solution generally contains ions to be plated onto the surface of the substrate, and therefore, the application of the electrical bias causes these ions to be urged out of the electrolyte solution and to be plated onto the electrically biased seed layer.

Conventional electrochemical plating cells utilize a contact element or contact ring that is configured to electrically engage a perimeter of the substrate surface in order to supply the electrical plating bias required to initiate and sustain plating operations. However, one drawback to this configuration is that when the substrate surface is immersed in the plating solution, the electrical contacts also generally contact the plating solution, and as a result thereof, metal ions in the solution are generally plated on the electrical contacts themselves and not on the substrate surface. In order to overcome this challenge the plating industry has attempted to provide contact elements that have a dry contact-type configuration. i.e., the electrical contact or contacts are generally surrounded by a seal that prevents the plating solution from touching the contact pins. Dry contact configurations show promise in that they are designed to isolate the electrical contact elements from the plating solution, which prevents metal ions in the solution from plating on the electrical contact elements. However, one challenge associated with dry contact configurations is that the pressure differential between the region where the plating solution is contained and the sealed region surrounding the electrical contacts has been shown to be prone to solution leakage, which eliminates the advantages provided by the dry contact configuration.

Therefore, there is a need for a dry electrical contact element for a substrate plating apparatus, wherein the dry electrical contact element overcomes the challenges associated with pressure differential driven fluid leakage across the dry contact seals.

SUMMARY OF THE INVENTION

Embodiments of the invention generally provide a method and apparatus for electrochemically processing a substrate. In one embodiment of the invention, a substrate holder assembly for contacting a substrate during the electrochemical processing of the substrate includes a contact ring having a substrate seating surface configured to retain the substrate during plating operations. The substrate seating surface includes at least one electrical contact pad or pin for making electrical contact with a front or production surface of the substrate. A first liquid-resistant barrier, such as a flexible seal, is disposed radially inward from the at least one contact pin. The first liquid-resistant barrier is disposed on the substrate seating surface and is configured to sealably contact the front surface of the substrate. A second liquid resistant barrier is positioned radially outward of the contact pin in a configuration that defines volume between the first liquid-resistant barrier and the second liquid resistant barrier, wherein the volume encloses the contact pins.

Embodiments of the invention may further provide a contact ring for an electrochemical plating system. The contact generally includes a substrate receiving member having a substrate support surface formed thereon, a plurality of electrical contact pins extending from the substrate support surface, a first seal positioned on the substrate support surface radially inward of the plurality of electrical contacts, and a second seal positioned radially outward of the plurality of electrical contacts. Additionally, the contact ring generally includes a fluid inlet configured to supply a fluid to a volume between the first seal and the second seal.

Embodiments of the invention may further provide a substrate support member for an electrochemical plating system. The substrate support member generally includes a substrate support surface, a plurality of electrical contact elements extending from the substrate support surface, and a first seal member positioned on the substrate support surface. Additionally, the substrate support member generally includes a second seal member positioned on the substrate support surface, wherein the first and second seal members define a seal volume therebetween when a substrate is positioned on the substrate support surface that encompasses the plurality of electrical contacts, and a fluid inlet in fluid communication with the seal volume.

Embodiments of the invention may further include a method for supporting a substrate during an electrochemical plating process. The method generally includes positioning the substrate on an annular substrate support surface, wherein the substrate support surface includes a plurality of radially positioned electrical contact elements, a first seal member positioned radially inward of the plurality of electrical contact elements, and a second seal positioned radially outward of the plurality of electrical contact elements, forming a seal volume defined by the annular substrate support surface, the substrate, the first seal, and the second seal, wherein the seal volume encompasses the plurality of electrical contact elements, and filling the seal volume with a fluid.

Embodiments of the invention may further provide a contact ring for an electrochemical plating system. The contact ring generally includes a substrate support surface, means for electrically contacting a substrate positioned on the substrate support surface, first means for sealing positioned radially inward of the means for electrically contacting, second means for sealing positioned radially outward of the means for electrically contacting, and means for introducing a fluid into a seal volume formed by the substrate support surface, first means for sealing, second means for sealing, and the substrate positioned on the substrate support surface.

BRIEF DESCRIPTION OF THE DRAWINGS

A more particular description of the invention, briefly summarized above, may be had by reference to the embodiments thereof that are illustrated in the appended drawings. It is to be noted, however, that the appended drawings illustrate only typical embodiments of this invention and, therefore, are not to be considered limiting of its scope, for the invention may admit to other equally effective embodiments.

DETAILED DESCRIPTION

Figure 1:
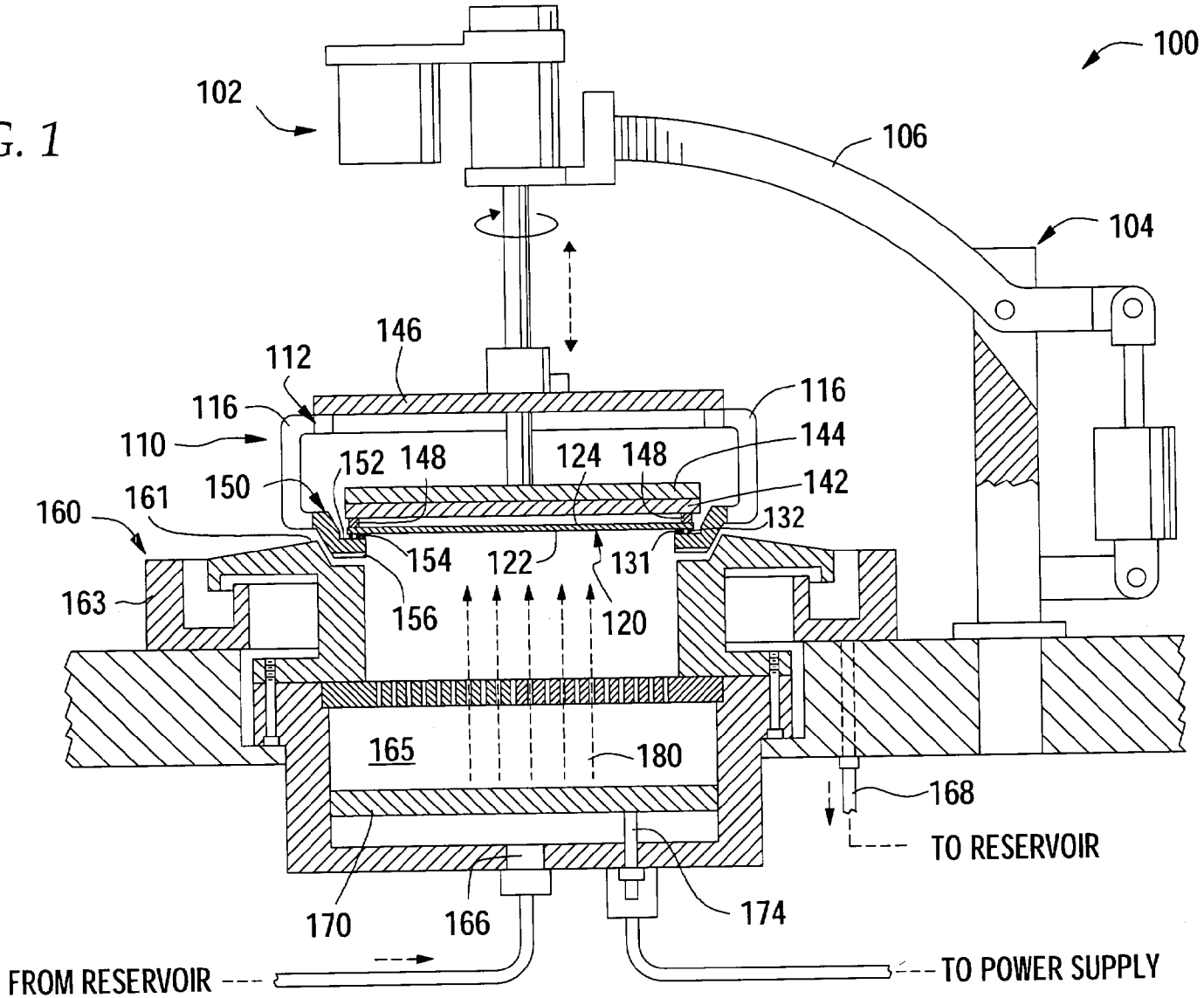
FIG. 1 illustrates a sectional and partial perspective view of a plating cell utilizing an embodiment of a contact ring of the invention.

FIG. 1 illustrates a partial perspective and sectional view of an exemplary electrochemical plating (ECP) system 100 utilizing an exemplary contact ring or substrate receiving member 150 of the invention. The ECP system 100 generally includes a head assembly 102, a substrate securing assembly 110, and a plating basin 161. The head assembly 102 is attached to a base 104 by a support arm 106 and is adapted to support the substrate securing assembly 110 at a position above the plating basin 161 in a manner that allows the head assembly 102 to position a substrate 120 (held in the substrate securing assembly 110) in a plating bath 165 for processing. The head assembly 102 may also be adapted to provide vertical, horizontal, rotational, and angular movement to the substrate securing assembly 110 before, during, and after the substrate 120 is placed in the plating bath 165. The plating basin 161 generally includes an inner basin 167, contained within a larger diameter outer basin 163. Any suitable technique may be used to supply a plating solution to the plating assembly 160. For example, a plating solution may be supplied to the inner basin 167 through an inlet 166 at a bottom surface of the inner basin 167. The inlet 166 may be connected to a supply line, for example, that is in fluid communication with a supply reservoir system (not shown). The outer basin 163 may operate to collect fluids that flow over a weir that defines the outer perimeter of the inner basin 167 and to drain the collected fluids via a fluid drain 168, which may also be connected to the electrolyte reservoir system in order to return the collected electrolyte to the reservoir.

An anode assembly 170 is generally positioned within a lower region of the inner basin 163. The anode assembly 170 may be any suitable consumable or non-consumable-type anode used for electrochemical plating operations. Generally, the anode assembly 170 is sized such that the outer perimeter of the anode assembly 170 is generally slightly smaller than the inner diameter of the fluid basin within which the anode assembly is positioned. Therefore, the size differential allows for a fluid passage between the outer edge of the anode and the inner wall of the fluid basin, and thus, fluid introduced into the fluid basin below the anode assembly 170 may flow upward around the perimeter of the anode assembly 170 upward toward the substrate 120 to be plated. For some embodiments, a membrane (not shown) may be generally positioned across the diameter of inner basin at a position above the anode assembly 170. The membrane may be any suitable type membrane, such as a cation membrane, an anion membrane, an uncharged-type membrane, a generally fluid permeable membrane, or a multi-layer diffusion differentiated fluid permeable membrane. However, when an ionic or other non-fluid permeable type membrane is used, embodiments of the invention contemplate using a first fluid inlet to provide fluid to the volume below the membrane and a second fluid inlet to provide another fluid to the volume above the membrane. In addition to the membrane, embodiments of the invention may additionally include a diffusion member (not shown) positioned above the anode assembly 170 and below the substrate being plated. Further, in embodiments where a membrane is utilized, the diffusion member may be positioned between the membrane and the substrate being plated. Generally the diffusion member is manufactured from a material that is fluid permeable, such as a porous ceramic disk, for example, and therefore, the diffusion member is generally configured to control fluid flow characteristics at the surface of the substrate. Further, the diffusion member is generally manufactured from a material that offers some control over the electric and magnetic fields traveling therethrough.

Any suitable method may be used to provide an electrical connection to the anode assembly 170. For example, an electrical connection to the anode assembly 170 may be provided through an anode electrode contact 174. The anode electrode contact 174 may be made from any suitable conductive material that is insoluble in the plating solution, such as titanium, platinum and platinum-coated stainless steel. As illustrated, the anode electrode contact 174 may extend through a bottom surface of the plating bath assembly 161 and may be connected to an anode connection of a power supply (not shown), for example, through any suitable wiring conduit. A cathode connection of the power supply may be connected to the contact ring 150 to supply an electrical bias between the anode assembly 170 and the substrate 120 that facilitates plating operations. Therefore, in response to the electrical bias applied between the anode assembly 170 and a plating surface 122 of the substrate 120, electrical current, represented by current flux lines 180, generally flows from the anode assembly 170 to the substrate 120. The current flux lines 180 may tend to gather at a perimeter edge of the substrate 120. Therefore, the contact ring 150 may include a plurality of scallops 156 generally formed beneath a plurality of contacts 154, wherein each of the contacts 154 are configured to contact the production or front surface of the substrate (the production or front side of the substrate is generally defined as the surface to be plated). The scallops 156 may serve to control the current flux lines 180 at the perimeter edge of the substrate 120 at or near the contacts 154, in an effort to control variations in current density along a perimeter edge of the substrate 120, as will be described in more detail below.

An upper substrate engaging surface 152 of the contact ring 150, e.g., the surface from which the contacts 154 extend and upon which the substrate being plated 120 is supported, generally includes a first seal 131 positioned radially inward of the contacts 154 and a second seal 132 positioned radially outward of the contacts 154. Seals 131 and 132 are generally manufactured from a material having sufficient rigidity to maintain its shape, while also having sufficient flexibility to provide crush for sealing. An example of such a material is Perlast™ from Precision Polymer Engineering, however, embodiments of the invention are not limited to any specific seal material. In embodiments of the invention where the contact ring 150 is circular, the configuration of the seals 131 and 132 will generally be annular, such as an O-ring type of seal. However, embodiments of the invention are not intended to be limited to circular or annularly shaped contact rings, as various other shapes, including squares, ovals, and other shapes of contact rings are applicable to the invention. Regardless of the particular shape of the ring and accompanying seals, the combination of the first and second seals 131, 132 generally operates to prevent fluids (generally plating solution) from passing between the respective seals and the substrate positioned in contact therewith, which generates a dry contact configuration, e.g., a configuration wherein the electrical contacts 154 electrically engage the substrate surface and are not in contact with the plating solution of the plating cell. For example, when a substrate is positioned on the substrate seating surface 152 of the contact ring 150, the production surface or the front side of the substrate engages the contact ring 150 near the perimeter of the substrate. The physical engagement between the substrate and the contact ring generally includes the surface of the substrate contacting each of the plurality of electrical contact elements 154, as well as both of the seals 131 and 132. The substrate is then mechanically biased against the contact ring 150 by a thrust plate that engages the backside of the substrate and pushes the substrate against the contact ring 150. When the substrate is pushed against the contact ring 150, the substrate is pushed against both seals 131 and 132, along with contacts 154. Therefore, when the substrate is pushed against the seals 131 and 132, a fluid seal is formed between the substrate and the seals, wherein fluid generally cannot pass between the seals and the substrate. In this embodiment of the invention fluid, and in particular, plating solution from the plating basin, is prevented from touching the contacts 154 via the sealed arrangement, and thus the contacts 154 generally remain dry, hence the term a "dry contact configuration."

Figure 2:
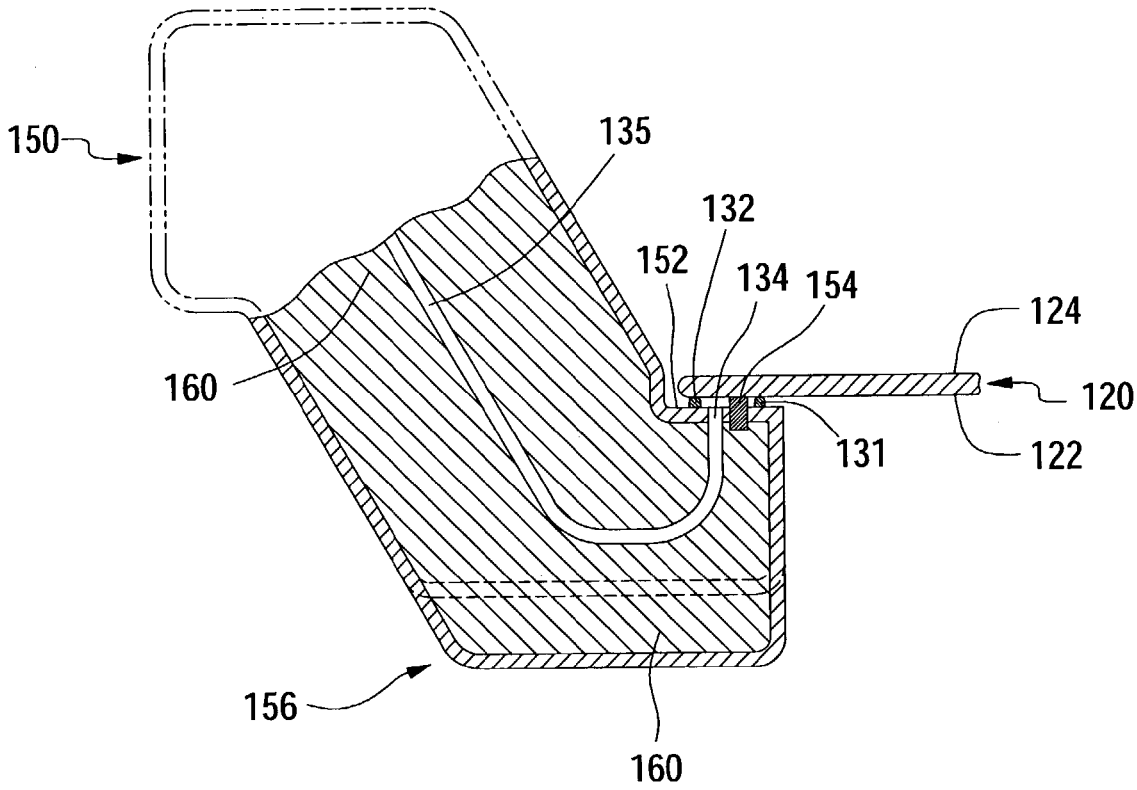
FIG. 2 illustrates a sectional view of an exemplary contact ring of the invention.

In another embodiment of the invention, the exemplary contact ring 150 further includes a fluid outlet positioned between seals 131 and 132. FIG. 2 illustrates a cross sectional view of an embodiment of a contact ring of the invention including the fluid outlet 134. The fluid outlet 134 may be positioned on the substrate seating surface 152 of the contact ring at generally any location between the respective seals 131 and 132. Fluid outlet 134 is generally in fluid communication with a fluid conduit 135 that is in fluid communication with a fluid source (not shown), wherein the fluid source is configured to supply a fluid to the annular volume between seal 131 and seal 132. The fluid conduit 135 may generally be formed into a frame portion of the contact ring 150 and is generally in fluid communication with a fluid supply (not shown). Additionally, a vent (not shown) may also be positioned on the contact ring seating surface 152, wherein the vent is configured to allow air or other gases in the volume between the seals 131 and 132 to escape or be vented therefrom when the fluid outlet 134 is flowing a fluid into the volume between the seals, which allows for the fluid outlet 134 to fill the volume between the respective seals 131, 132 without substantially increasing the pressure in the volume. Therefore, generally the vent is selectively opened or closed in order to both allow for easy filling of the volume when the vent is in the open position, and alternatively, the vent may be closed to allow for pressurization of the volume when the fluid is introduced into the volume.

The fluid source in fluid communication with the fluid outlet 134 may generally include a source configured to contain deionized water, an electrolyte solution, an oxide removal solution, a hydrogen peroxide solution, an acid solution source, or any other fluid source that may be used in conjunction with an electrochemical plating process. In embodiments where the fluid provided to fluid outlet 134 is acidic or otherwise an etchant for semiconductor substrates, the combination of the seals and fluid may be used to conduct an in situ edge bead or exclusion zone removal process. For example, an etchant may be flowed into the volume between the two seals at a point in the electrochemical plating process when it is desired to remove the seed layer in the region covered by the volume. The acid or etchant will then generally react with the seed layer and remove it from the substrate. As such, the seed layer is removed from the exclusion zone of the substrate without having to transfer the substrate to another processing cell, e.g., an edge bead or bevel clean cell.

The substrate securing assembly 110 generally includes a mounting member 112 attached to the contact ring 150 via attachment members 116. The attachment members 116 may be spaced sufficiently to allow insertion of the substrate 120 (e.g., a spacing of the attachment members 116 may be greater than a diameter of the substrate 120). The mounting member 112 may allow for attachment of the substrate securing assembly 110 to the head assembly 102, via a mounting plate 146 of a thrust plate assembly. Other embodiments of the substrate securing assembly 110 may lack the mounting member 112 and may be attached, for example, directly to the mounting plate 146 via the contact ring 150. The mounting member 112, contact ring 150, and the attachment members 116 may each be coated with a plating-resistant material, such as a PTFE material (e.g., Aflon® or Tefzel®) or any other suitable plating-resistant coating material.

The contact ring 150 may have a substrate seating surface 152 generally adapted to receive the substrate 120 with the plating surface 122 of the substrate facing the plating bath 165. The substrate securing assembly 110 may also include a thrust plate 144, as generally discussed above, with an attached seal plate 142 generally adapted to exert a securing force on the substrate 120 for securing the substrate 120 to the substrate seating surface 152. The securing force applied by the thrust plate 144 may be sufficient to ensure adequate sealing between an annular sealing member 148 disposed on the seal plate 142 and the non-plating surface 124 of the substrate. As illustrated, the annular sealing member 148 may be adapted to contact the non-plating surface 124 of the substrate 120 at a substantially equal location radially inward from an edge of the substrate as the contacts 154 engage the plating surface 122 of the substrate. For some embodiments, the substrate securing assembly 110 may include an inflatable bladder assembly (not shown) adapted to apply a downward force that is evenly distributed along the non-plating surface 124 of the substrate 120.

The securing force exerted by the thrust plate 144 may also be sufficient to ensure adequate electrical contact between the plating surface 122 of the substrate and the contacts 154 extending from the substrate seating surface 152 of the contact ring 150. The contacts 154 are generally adapted to electrically contact the plating surface 122 of the substrate 120 in order to supply an electrical plating bias to the plating surface 122. The contacts 154 may be made of any suitable conductive material, such as copper (Cu), platinum (Pt), tantalum (Ta), titanium (Ti), gold (Au), silver (Ag), stainless steel, an alloy thereof, or any other suitable conducting material.

As illustrated in FIG. 2, the contacts 154 may be formed above the scallops 156 in a generally circular pattern around the substrate seating surface 152 of the contact ring 150. The contacts 154 may vary in number, for example, according to a size of the substrate 120. The contacts 154 may also be flexible in order to contact plating surfaces with non-uniform heights. Power may be supplied to the contacts 154 via a power supply (not shown). The power supply may supply electrical power to all of the electrical contacts 154 cooperatively, banks or groups of the electrical contacts 154 separately, or to the individual contacts 154. In embodiments where current is supplied to groups or individual contacts 154, a current control system may be employed to control the current applied to each group or pin.

For some embodiments, the contact ring 150, attachment members 116 and mounting member 112 may all be made of an electrically conductive material. As with the contacts 154, the contact ring 150, attachment members 116, and mounting member 112 may be made of any suitable electrically conductive material and, for some embodiments, may be made of stainless steel. Accordingly, the attachment members 116 may electrically couple the mounting member 112 and the contact ring 150. Therefore, power may be supplied to the contacts 154 by one or more electrical connections between the mounting member 112 and a power supply. Further, for some embodiments, the mounting member 112 may be physically and electrically coupled with the thrust plate mounting plate 146, which may also be made of an electrically conductive material and may be attached to a power supply. The mounting member 112 or mounting plate 146 may be connected to the power supply via any suitable attachment means adapted to provide power to the contacts 154 as the substrate securing assembly 110 is moved (e.g., raised, lowered and rotated) by the head assembly 102 of FIG. 1. As previously described, the seal plate 142 may be attached to the thrust plate 144. The thrust plate 144 may be adapted to move (i.e., up and down) independently of the contact ring 150 to exert a securing force with the sealing member 148 on the non-plating surface of a substrate to secure the substrate to the substrate seating surface 152 of the contact ring 150. The sealing member 148 may be designed to provide a uniform contact force between the contacts 154 and the plating surface of the substrate.

Figure 3:
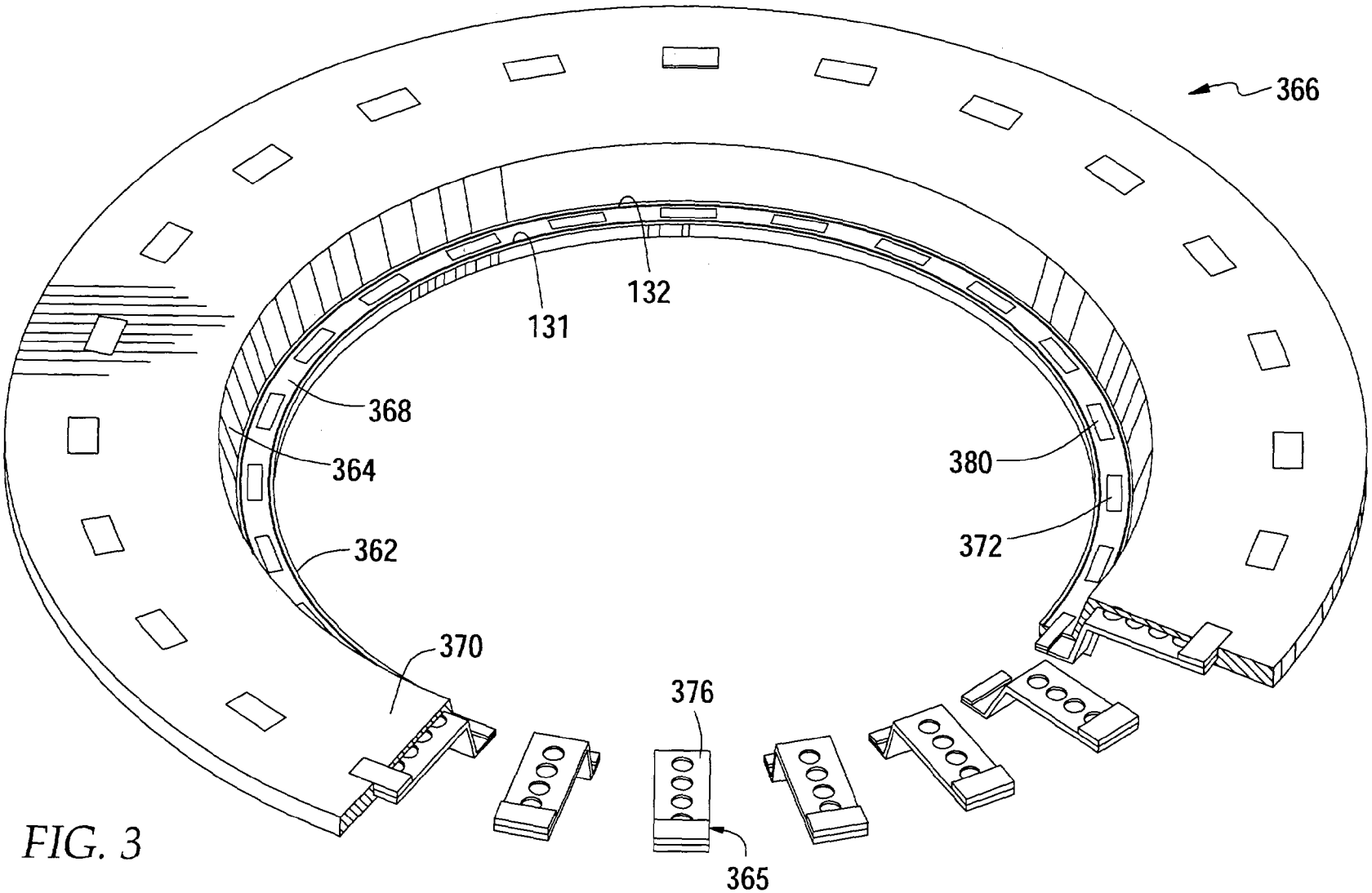
FIG. 3 illustrates a perspective and partial sectional view of another exemplary contact ring of the invention.

FIG. 3 illustrates another embodiment of an exemplary contact ring 366 of the invention. Contact ring 366 generally includes a plurality of conducting members 365 at least partially disposed within an annular insulative body 370. The insulative body 370 is shown having a flange 362 and a downward sloping shoulder portion 364 leading to a substrate seating surface 368 located below the flange 362 such that the flange 362 and the substrate seating surface 368 lie in offset and substantially parallel planes. Thus, the flange 362 may be understood to define a first plane while the substrate seating surface 368 defines a second plane parallel to the first plane wherein the shoulder 364 is disposed between the two planes. However, the contact ring design shown in FIG. 3 is intended to be merely illustrative. In another embodiment, the shoulder portion 364 may be of a steeper angle including a substantially vertical angle so as to be substantially normal to both the flange 362 and the substrate seating surface 368. Alternatively, the contact ring 366 may be substantially planar thereby eliminating the shoulder portion 364. The conducting members 365 are defined by a plurality of outer electrical contact pads 380 annularly disposed on the flange 362, a plurality of inner electrical contact pads 372 disposed on a portion of the substrate seating surface 368, and a plurality of embedded conducting connectors 376 which link the pads 372, 380 to one another. The conducting members 365 are isolated from one another by the insulative body 370 which may be made of a plastic such as polyvinylidenefluoride (PVDF), perfluoroalkoxy resin (PEA), Teflon™, and Tefzel™, or any other insulating material such as Alumina (Al2O3), or other ceramics. The outer contact pads 380 are coupled to a power supply (not shown) to deliver current and voltage to the inner contact pads 372 via the connectors 376 during processing. In turn, the inner contact pads 372 supply the current and voltage to a substrate by maintaining contact around a peripheral portion of the substrate. Thus, in operation the conducting members 365 act as discrete current paths electrically connected to a substrate.

Low resistivity, and conversely, high conductivity, are directly related to good plating. To ensure low resistivity, the conducting members 365 are preferably made of copper (Cu), platinum (Pt), tantalum (Ta), titanium (Ti), gold (Au), silver (Ag), stainless steel or other conducting materials. Low resistivity and low contact resistance may also be achieved by coating the conducting members 365 with a conducting material. Thus, the conducting members 365 may, for example, be made of copper (resistivity for copper is approximately 2×10–8 Ω·m) and be coated with platinum (resistivity for platinum is approximately 10.6×10–8 Ω·m). Coatings such as tantalum nitride (TaN), titanium nitride (TiN), rhodium (Rh), Au, Cu, or Ag on a conductive base materials such as stainless steel, molybdenum (Mo), Cu, and Ti are also possible. Further, since the contact pads 372, 380 are typically separate units bonded to the conducting connectors 376, the contact pads 372, 380 may comprise one material, such as Cu, and the conducting members 365 may comprise another material, such as stainless steel. Either or both of the pads 372, 380 and conducting connectors 376 may be coated with a conducting material. Additionally, because plating repeatability may be adversely affected by oxidation which acts as an insulator, the inner contact pads 372 preferably comprise a material resistant to oxidation such as Pt, Ag, or Au. The contact ring 366 generally includes two seals 131 and 132 positioned radially inward and radially outward of the contacts 372, respectively.

In another embodiment of the invention the respective seals (seals 131 and 132) may be positioned on opposing sides of the substrate. For example, the first seal 131 may be formed onto the substrate seating surface 152 of the contact ring, while the second seal 132 may be formed onto the lower surface of the thrust plate 142. In this configuration, however, the contact ring generally includes solid sides, i.e., the contact ring is generally a solid bowl shaped ring with an aperture formed through a lower portion of the bowl (as illustrated in the embodiment in FIG. 3—less the second seal positioned radially outward of the electrical contacts). Thus, the substrate may be positioned on a seating surface that is in the same plane as the aperture, wherein the seating surface has the first seal positioned proximate the aperture. Then the thrust plate may be lowered and used to bias the substrate against the first seal (which is positioned radially inward of the electrical contact pins). Further, the thrust plate may include the second seal 132 formed on a lower surface, which operates to form a sealed volume between the first and second seals. However, in this configuration, the sealed volume extends around the bevel of the substrate between the two seals.

In operation, embodiments of the invention generally provide a contact ring using a dry or sealed contact configuration, e.g., the contacts are isolated from the plating solution. More particularly, the sealed contact configuration is set up such that a fluid, i.e., a fluid other than a plating solution, may be provided to a sealed volume surrounding the contacts of a contact ring. The presence of the fluid in the sealed volume provides a minimal pressure differential across the contact ring seals, and therefore, minimizes plating solution leakage into the fluid volume surrounding the contacts. Thus, embodiments of the invention generally provide a dry contact configuration wherein the dry region or volume of the contact ring is filled with a fluid other than the plating solution.

More particularly, referring to FIG. 2, the exemplary contact ring 150 of the invention may be used to plate a metal, such as copper for example, onto a semiconductor substrate, while maintaining the electrical contacts 154 of the contact ring 150 isolated from the plating solution used to plate the metal onto the substrate. In this configuration a substrate to be plated, generally designated substrate 120, is loaded into the contact ring 150 by a robot (not shown). The substrate 120 is generally positioned such that the production surface or plating surface of the substrate is facing downward or towards a plating solution basin 163 positioned adjacent thereto. Once the substrate 120 is positioned in the contact ring, i.e., once the substrate is sitting on the substrate support surface 152 of the contact ring 150, then the thrust plate assembly 144 is generally used to mechanically bias the substrate against the contacts 154 and seals 131 and 132 of the contact ring. In this position the substrate is generally pressed against the seals 131, 132 and the contacts 154 such that first, the contacts 154 make good electrical contact with a seed layer formed on the surface of the substrate 120, and second, the seals 131, 132 make good sealing contact with the surface of the substrate 120.

Once the substrate 120 is positioned on the contact ring 150 and secured thereto via the thrust plate 144, then the entire assembly (the contact ring and the substrate supported therein) is generally ready for immersion into the plating solution. Thus, the assembly may be lowered into a bath of plating solution, e.g., plating cell 161 for plating operations. However, either before, during, or after the immersion process a fluid is generally caused to flow into the sealed volume of space surrounding the contact pins 154, i.e., the space bounded at a lower portion by the substrate support surface 152 of the contact ring, at an upper portion by the substrate 120, and on two opposing sides by seals 131 and 132. The fluid is generally a fluid other than the plating solution, as an object of the invention is to prevent plating solution from touching the contact pins. The solution flowed into the bounded volume may generally be either an electrically resistive fluid, an electrically conductive fluid, or a fluid configured to clean the contacts. For example, an electrically resistive or insulating fluid would operate to electrically isolate the respective contact pins 154 from each another. Alternatively, if an electrically conductive fluid is used, then each of the contacts 154 would generally be in electrical communication with each other. Further, if an electrically conductive fluid is used, then the fluid would also be in electrically communication with the substrate in the area between the respective seals 131 and 132. Thus, the conductive fluid may operate to generate a continuous annular conductive contact with the substrate. Generally, the fluid that is pumped into the volume between the respective seals has a viscosity greater than about 0.1 centipoise. Further, the fluid is generally pressurized in the volume between the respective seals, wherein the pressure is between about 0.01 psi and about 20 psi. In further embodiments, the upper limitation of the pressure may be about 5 psi or about 10 psi, for example. Regardless, the fluid between the seals is generally an incompressible fluid.

Another function of the fluid positioned in the volume between the seals is that the fluid prevents the plating solution from touching the electrical contacts 154. More particularly, in conventional configurations where one or more seals are used to prevent the plating solution from touching the contact pins, generally the volume surrounding the contact pins is filled with atmospheric pressure air. Therefore, when the contact ring is immersed into the plating solution for plating operations, there is an inherent pressure differential across the seals of the contact, and more particularly, there is a pressure differential across the seal of the contact ring that separates the plating solution from the air volume surrounding the contacts. Generally this pressure differential is negative on the air side, and therefore, the plating solution naturally wants to flow across the seal into the volume of air surrounding the contacts. However, when a fluid (other than a plating solution) is inserted into the volume surrounding the contacts, the fluid operates to minimize the pressure differential across the seal, which directly minimizes the tendency of the plating solution to flow across the seal to the contacts. Further, a positive pressure in the fluid between the seals may be used to prevent leakage, as any leak will be reversed by the positive pressure and the fluid in the volume between the seals and the fluid will flow across the seal in the reverse direction of the leak. The pressurization of the volume between the seals may also be used to facilitate removal of the substrate from the sealing surfaces, as the positive pressure will act to assist the substrate from disengaging from the seals. More particularly, the sealed volume may slightly be over pressurized prior to disengagement, which will operate to push the substrate off of the seals.

In embodiments of the invention where an electrically conductive fluid is utilized to fill the volume between seals 131 and 132, then the conductive fluid may operate to replace the contact pins 154. More particularly, when an electrically conductive fluid is used the fluid itself may be used as the primary means of electrically contacting the substrate surface. As such, the contact pins 154 may be reduced in number and/or reduced in height, such that the contact pins 154 still electrically communicate with the fluid and supply electrical power thereto, however, the pins 154 generally will not physically engage the substrate surface in this configuration. The conductive fluid is generally configured to be capable of electrically engaging the substrate at an infinite number of points throughout the annular area defined by the volume of fluid over the substrate. Further, the fluid is generally configured to be capable of transmitting the electrical power provided thereto from the contact pins 154 to the substrate surface for plating operations.

In another embodiment of the invention, the fluid pressure in the volume between the seals may be monitored during a plating process. More particularly, the fluid pressure in the volume between the seals may be monitored for pressure drops, which generally indicate that there is a fluid leak in one of the seals surrounding the electrical contact pins. The monitoring may be controlled by a microprocessor based control system or other type of control system generally used to control semiconductor processes.

While the foregoing is directed to various embodiments of the invention, other and further embodiments of the invention may be devised without departing from the basic scope thereof, and the scope thereof is determined by the claims that follow.

What is claimed is:

1. A method for supporting a substrate during an electrochemical plating process, comprising:

positioning the substrate on an annular substrate support surface, wherein the substrate support surface includes a plurality of radially positioned electrical contact elements, a first seal member positioned radially inward of the plurality of electrical contact elements, and a second seal positioned radially outward of the plurality of electrical contact elements;

forming a seal volume defined by the annular substrate support surface, the substrate, the first seal, and the second seal, wherein the seal volume encompasses the plurality of electrical contact elements; and filling the seal volume with an incompressible fluid.

2. The method of claim 1, further comprising venting the seal volume for the filling the seal volume.

3. The method of claim 1, further comprising pressurizing the seal volume via the filling the seal volume.

4. The method of claim 1, wherein the fluid is an electrically resistive fluid.

5. The method of claim 1, wherein the filling the seal volume further comprises filling the seal volume with an electrically conductive fluid that is configured to electrically contact the substrate throughout the seal volume.

6. The method of claim 1, wherein positioning further comprises physically and electrically engaging a front surface of the substrate with the plurality of electrical contacts.

* * * * *